United States Patent [19]

Trout

[11] 3,991,887

[45] Nov. 16, 1976

[54] METHOD AND APPARATUS FOR MOVING DRILL PIPE AND CASING

[76] Inventor: Norman L. Trout, 602 N. Broadway, Sayre, Okla. 73662

[22] Filed: Feb. 24, 1975

[21] Appl. No.: 552,698

[52] U.S. Cl. ..... 214/2.5; 214/1 P
[51] Int. Cl.[2] ..... E21B 19/00
[58] Field of Search ..... 214/2.5, 1 P, 1 PA, 214/1 BD, 130 R; 175/85

[56] References Cited

UNITED STATES PATENTS

| | | | |
|---|---|---|---|
| 3,177,944 | 4/1965 | Knights | 214/2.5 |
| 3,561,616 | 2/1971 | Eddy | 214/2.5 |
| 3,805,902 | 4/1974 | Storm | 214/2.5 |
| 3,825,129 | 7/1974 | Beck | 214/2.5 |

*Primary Examiner*—M. H. Wood, Jr.
*Assistant Examiner*—John A. Carroll
*Attorney, Agent, or Firm*—Laney, Dougherty, Hessin & Fish

[57] ABSTRACT

A road transportable apparatus for moving drill pipe and casing including a rigid support frame assembly with a bifurcated mast assembly pivotally secured thereto, the support frame assembly being rigidly securable to the walk of a conventional drilling rig pipe rack. A hydraulic power cylinder is employed to rotate the mast assembly relative to the support frame assembly. Power winches are included and operate cables extending therefrom over the outer end of the mast assembly where they are securable to the respective opposite ends of the length of drill pipe or casing suspended therebelow. A hydraulic control system is disclosed for controlling the operation of the power cylinder and the power winches. A demountable trailer frame assembly is provided for supporting the support frame assembly and mast assembly when transported over the ground.

12 Claims, 14 Drawing Figures

METHOD AND APPARATUS FOR MOVING DRILL PIPE AND CASING

BACKGROUND OF THE INVENTION

1. Field of the Invention

This invention relates generally to improvements in oil field equipment, and more particularly, but not by way of limitation, to improve apparatus for moving lengths of drill pipe or casing back and forth between a drilling rig pipe rack and the floor of a drilling rig.

2. Description of the Prior Art

During the drilling of an oil well it is necessary to move lengths of drill pipe and casing into an upright position in the derrick of the drilling rig from a substantially horizontal position on the pipe rack adjacent to the drilling rig. It is also necessary to remove lengths of drill pipe or the like from the derrick and place them on the pipe rack from time to time. One means of moving such lengths of pipe from the pipe rack is to attach a cable extending downwardly from the upper portion of the derrick to one end of each length of pipe to be moved from the pipe rack to the floor of the drilling rig. The cable is then pulled up into the derrick by suitable winch means to drag the length of pipe along the walk and up a ramp extending from the walk to the floor of the drilling rig through the V-door of the derrick until the length of pipe is positioned vertically within the derrick set in a desired position on the floor of the rig. During the movement of pipe in this manner, the threads on the pipe are often damaged and other damage to the pipe is sustained. Movement of large diameter lengths of casing in this manner is also extremely hazardous to the relatively expensive casing and dangerous to the personnel working on the rig due to the weight of the lengths of casing.

Other means have been used to provide improved movement of the lengths of pipe or casing from the pipe rack to the drilling rig derrick and floor such as by permanently installed hydraulically actuated masts which are mounted directly to the drilling rig. Such masts, however, remain idle a great portion of the time since movement of lengths of pipe and casing between the pipe rack and the rig floor is not a continuous process during the drilling of an oil well.

Another means employed, particularly in the handling of large diameter lengths of casing, involves the use of large, expensive truck-mounted steel erection derricks for lifting and handling lengths of casing. The latter method is relatively expensive due to the costs involved in employing the derrick and the derrick operator.

The present invention contemplates a pipe handling apparatus for moving drill pipe and casing back and forth between a position reclining on the horizontal drilling rig pipe rack and a position on the rig floor via the V-door of the drilling rig. The apparatus includes a support frame, a bifurcated mast having first and second ends and pivotally secured to the first end thereof to the support frame, and clamping means carried by the support frame for securing the support frame to the drilling rig pipe rack whereby the mast may rotate relative to the support frame about a horizontal axis. The apparatus further includes power cylinder means interconnecting the support frame and the bifurcated mast for rotating the mast about the axis of pivotal securement to the support frame. A first power winch is carried by the support frame adjacent the first end of the bifurcated mast and sheave means are mounted on the second end of the bifurcated mast for rollingly supporting a cable passing thereover. A cable is secured at one end thereof to the first power winch and extends over the sheave means with the opposite end of the cable depending from the second end of the bifurcated mast. The apparatus further includes pipe securing means carried on the opposite end of the cable for releasably securing a length of pipe to the cable, and, control system means for controlling the extension and retraction of the power cylinder to swing the second end of the bifurcated mast from a position extending over the rig pipe rack to a position adjacent to the V-door and floor of the drilling rig and, alternatively, from a position adjacent to the V-door and floor of the drilling rig to a position extending over the drilling rig pipe rack, and for controlling the operation of the first power winch to alternately wind and unwind the cable thereon.

An object of the invention is to provide apparatus to increase the efficiency of moving drill pipe and casing back and forth between a position on a drilling rig pipe rack and a position on the drilling rig floor.

Another object of the invention is to provide pipe-handling apparatus for use in moving drill pipe and casing between a drilling pipe rack and the floor of the drilling rig which apparatus is readily transportable between various drilling rigs in an oil field.

A further object of the invention is to provide improved pipe-handling apparatus for moving drill pipe and casing back and forth between the pipe rack and the rig floor which prevents damage to the pipe casing during the movement operation.

A still further object of the invention is to provide a pipe-handling apparatus for moving drill pipe and casing back and forth between a pipe rack and the rig floor which is readily transportable, simple to install and remove from the drilling rig, and economical in construction and operation.

Other objects and advantages of the invention will be evident from the following detailed description when read in conjunction with the accompanying drawings.

BRIEF DESCRIPTION OF THE DRAWINGS

FIG. 3 is a side elevation view of the apparatus of the present invention with the demountable trailer frame assembly and two bar assembly installed thereon and illustrating the apparatus secured to the trailer hitch of a truck.

DESCRIPTION OF THE PREFERRED EMBODIMENT

Figure 1:
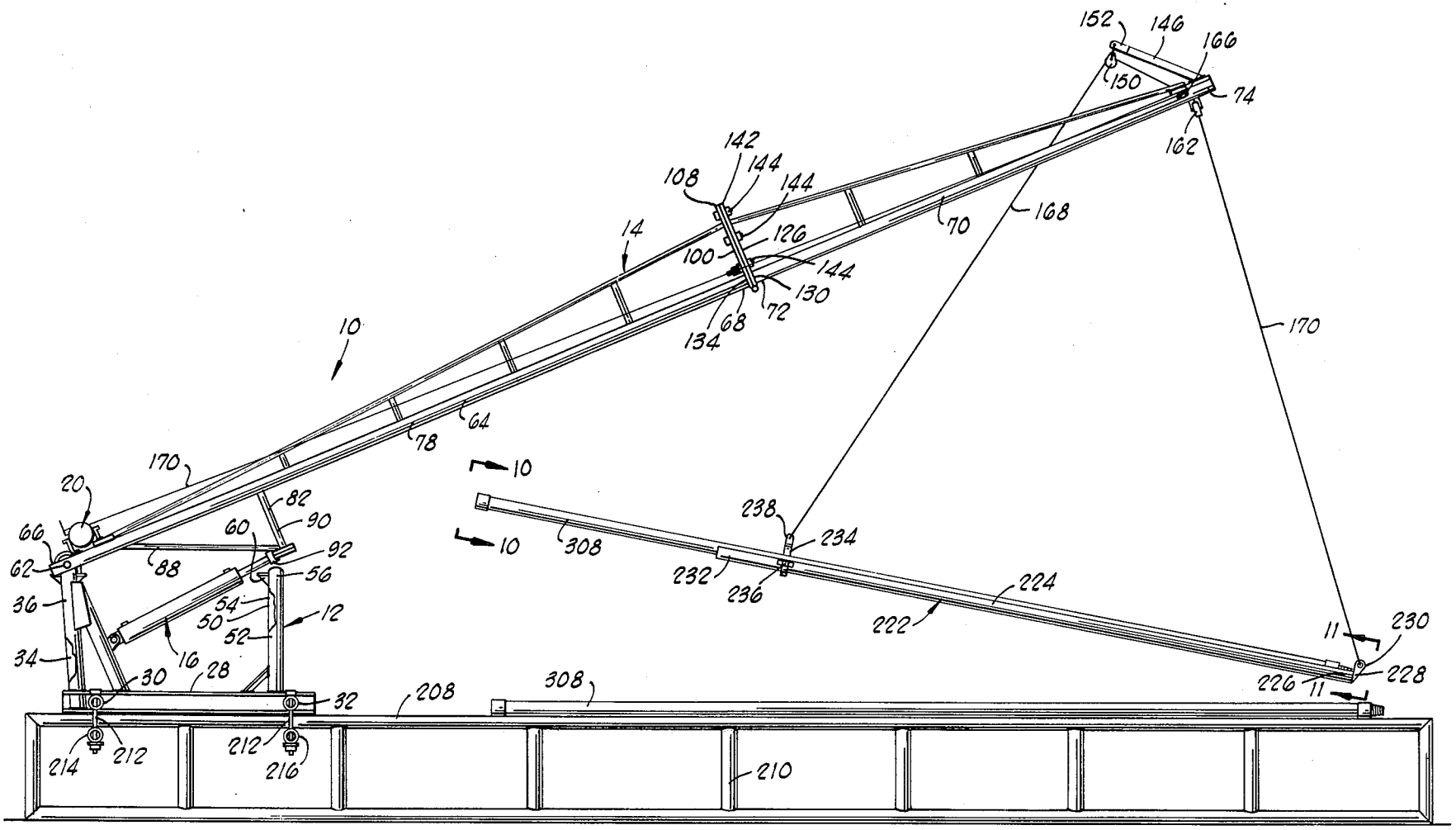
FIG. 1 is a side elevation view of the apparatus of the present invention mounted on the walk of the drilling rig pipe rack with the mast assembly in a partially elevated position.

Referring now to the drawings, the apparatus for moving drill pipe and casing into and out of an oil well derrick of the present invention is generally designated by the reference character 10. The apparatus 10 comprises a support frame assembly 12, a bifurcated mast or boom assembly 14 pivotally secured to the support frame assembly 12, a hydraulic power cylinder 16 interconnecting the support frame assembly 12 and the mast assembly 14 and first and second power winches 18 and 20 mounted on the mast assembly 14.

The apparatus 10 further includes a demountable trailer frame assembly 22 securable to the support frame assembly 12 and a demountable tow bar assembly 24 securable to the mast assembly 14.

The support frame assembly 12 comprises a pair of parallel longitudinal frame members 26 and 28 which may be suitably formed of steel I-beams. The longitudinal frame members 26 and 28 are secured together by means of a pair of parallel transverse frame members 30 and 32 which may be suitably formed of steel tubing or the like. A pair of vertical supporting members 34 and 36 are secured respectively to the frame members 26 and 28 adjacent the transverse frame member 30 and extend upwardly therefrom in substantially parallel relation. A transverse mast supporting member 38 interconnects the upper ends of the vertical support members 34 and 36 and extends along a line parallel to the transverse frame member 30. The mast supporting member 38 is preferably formed of the steel tubing and is open at both ends with the longitudinal passageway extending therethrough. A pair of brace members 40 and 42 interconnect the upper end portions of the vertical supporting members 34 and 36 and the longitudinal frame members 26 and 28, respectively. A transverse member 44 extends between the brace members 40 and 42 and is connected at its medial portion 46 to one end 48 of the hydraulic power cylinder 16.

A pair of vertical supporting members 50 and 52 are secured at their lower ends to the longitudinal frame members 26 and 28 adjacent to the transverse frame member 32 and extend upwardly therefrom in substantially parallel relation. The upper ends 54 and 56 of the supporting members 50 and 52 are adapted to engage and support the mast assembly 14 in its downwardly folded position as will be described in more detail hereinafter. Flanges 58 and 60, having apertures formed therein, extend from the upper ends 54 and 56 and provide means for securing the mast assembly 14 to the supporting members 50 and 52 during the transporting of the apparatus 10 as will also be described in more detail hereinafter.

The mast assembly 14 comprises a pivoting axle 62 extending through and journaled in the mast supporting member 38 of the support frame assembly 12. The mast assembly 14 further includes a lower mast frame 64 having a lower end 66 and an upper end 68 and an upper mast frame 70 having a lower end portion 72 and an upper end portion 74.

The lower end portion 66 of the lower mast frame 64 is secured to the axle 62 and is adapted to rotate therewith. The lower mast frame 64 includes a pair of substantially parallel main mast members 76 and 78 extending from the axle 62 and interconnected by a transverse frame member 80. A cylinder mounting member 82 is connected to and extends downwardly from the medial portion 84 of the frame member 80. Brace members 86 and 88 extend between the lower end portion 90 of the cylinder mounting member 82 and the main members 76 and 78 adjacent the axle 62, respectively. The opposite end 92 of the hydraulic power cylinder 16 is pivotally secured to the lower end portion 90 of the cylinder mounting member 82. Brace members 94 and 96 are secured to and extend from the medial portion 84 of the transverse frame member 80 to rigid engagement with the main mast members 76 and 78, respectively.

Butt plates 98 and 100 are secured respectively to the main mast members 76 and 78 at the upper end portion 68 of the lower mast frame 64. Rigid brace members 102 and 104 extend between the upper end portions 106 and 108 of the butt plates 98 and 100 and the main mast members 76 and 78 adjacent the axle 62.

Figure 4:
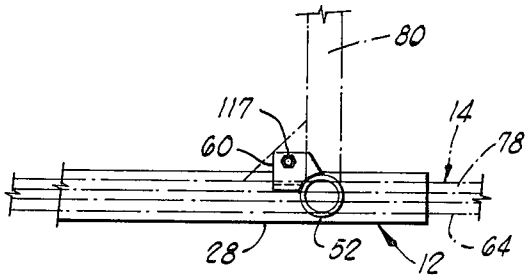
FIG. 4 is an enlarged partial top plan view illustrating the mechanism for securing the mast assembly to the support frame assembly during transport of the apparatus over the ground.
Figure 12:
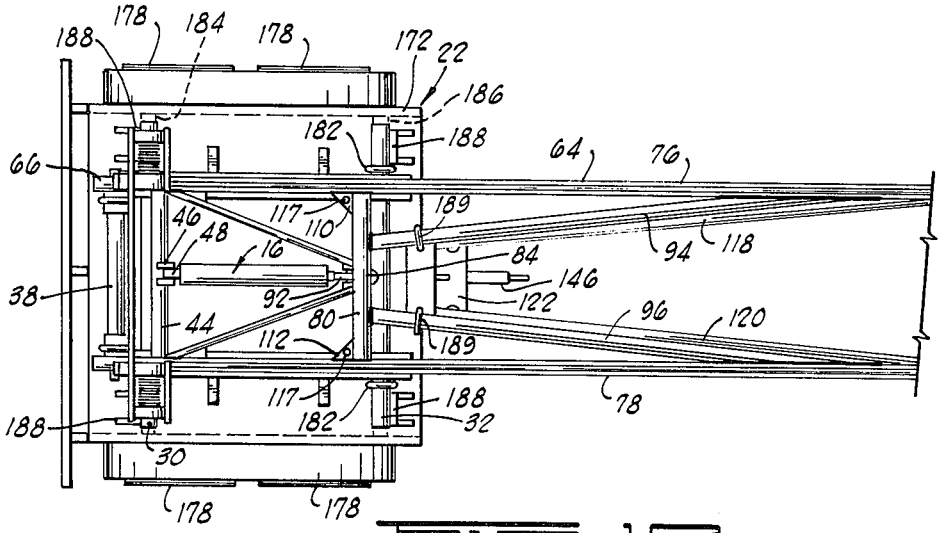
FIG. 12 is a partial plan view of the rearward portion of the apparatus as shown in FIG. 3.
Figure 13:
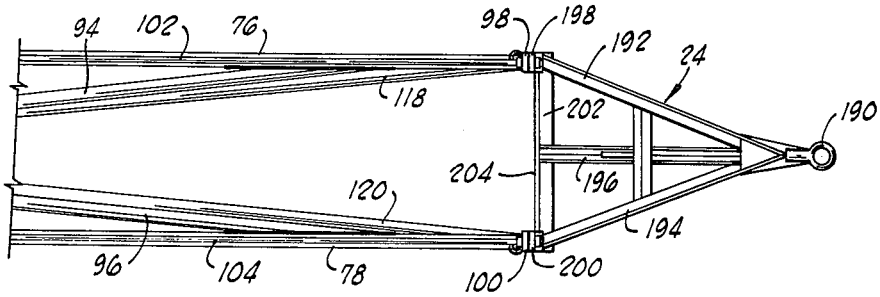
FIG. 13 is a partial plan view of the forward portion of the apparatus as shown in FIG. 3.

Plates 110 and 112 are secured between the transverse frame member 80 and the main members 76 and 78, respectively. Apertures 114 and 116 are formed respectively in the plates 110 and 112 and are positioned for coincident alignment with the apertures formed in the flanges 58 and 60 of the support frame assembly 12 when the mast assembly 14 is in its fully downwardly folded position relative to support frame assembly 12. When transported, the mast assembly 14 may be secured in the downwardly folded position to the support frame assembly 12 by means of threaded bolts 117 mutually engaging the plate 110 and the flange 58 and mutually engaging the plate 112 and the flange 60 through the apertures formed therein as shown in FIGS. 4 and 12.

The upper mast frame 70 includes a pair of substantially parallel upper main mast members 118 and 120. The upper end portion 74 of the upper mast frame 70 includes a transverse frame member 122 interconecting the upper main mast members 118 and 120. At the lower end portion 72 of the upper mast frame 70 butt plates 124 and 126 are fixedly secured to the upper main mast members 118 and 120, respectively. The lower end portions 128 and 130 of the butt plates 124 and 126 are hingedly secured to the lower end portions 132 and 134 of the butt plates 98 and 100 of the lower mast frame 64, respectively. Rigid brace members 136 and 138 interconnect the upper end portions 140 and 142 of the butt plates 124 and 126 and the upper main members 118 and 120 adjacent the transverse frame member 122, respectively.

Figure 2:
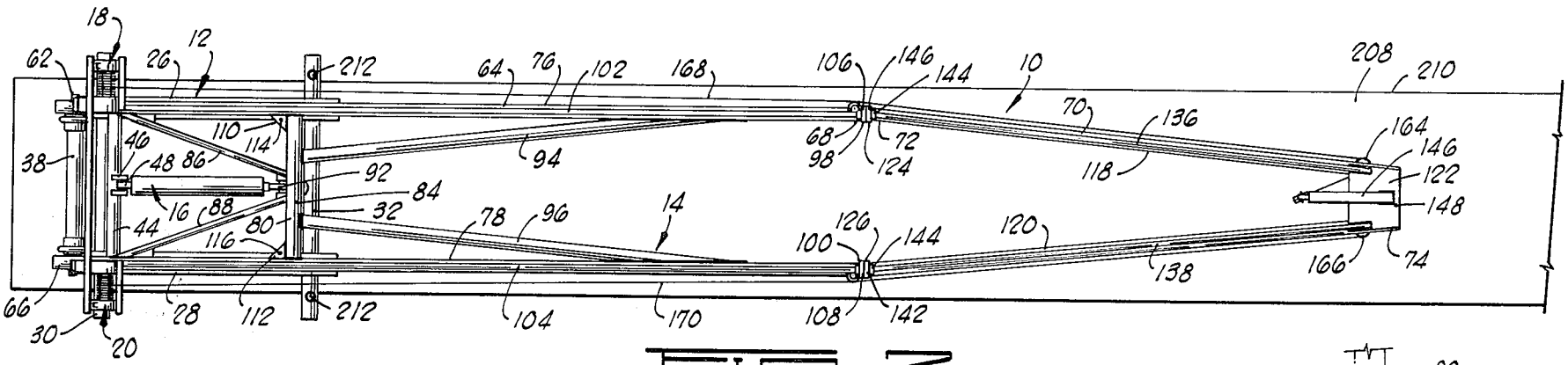
FIG. 2 is a top plan view of the apparatus illustrated in FIG. 1.

The lower mast frame 64 and the upper mast frame 70 are secured together in erected position, as shown in FIGS. 1 and 2, by means of a plurality of threaded bolts 144 extending through aligned apertures formed in and mutually engaging the butt plates 98 and 124 and the butt plates 100 and 126. It will be seen that, in the erected position, the main mast member 76 and the upper main mast member 118 are in substantial alignment as are the main mast member 78 and the upper main mast member 120 although the upper main mast members are inclined slightly toward each other from the lower end portion 72 of the upper end portion 74 of the upper mast frame 70.

The upper mast frame 70 further includes a cable supporting arm 146 secured to and extending from the medial portion 148 of the transverse frame member 122. A cable pulley or sheave 150 is secured to and depends from the outer end 152 of the cable supporting arm 146.

A cable pulley or sheave 162 is secured to and depends from the medial portion 148 of the transverse frame member 122. A cable pulley or sheave 164 is journaled on the upper main mast member 118 relatively near the cable pulley or sheave 150. Another cable pulley or sheave 166 is journaled on the upper main mast member 120 adjacent the transverse frame member 122.

The first power winch 18 is mounted on the boom assembly 14 adjacent the interconnection between the main mast member 76 and the rigid brace member 102. The second power winch 20 is mounted on the boom assembly 14 adjacent the interconnection between the main mast member 78 and the rigid brace member 104. A first cable 168 is spooled on the first power winch 18 and extends therefrom along the main mast member 76 and the upper main mast member 118 and passes over the cable pulleys or sheaves 164 and 150 with the free end thereof depending from the cable pulley or sheave 150. A second cable 170 is spooled on the second power winch 20 and extends therefrom along the main mast member 78 and the upper main mast member 120 where it passes over cable pulleys or sheaves 166 and 162 with the free end thereof depending from the cable pulley or sheave 162. It will be seen that the cable pulleys or sheaves 164, 150, 166 and 162 rollingly support the respective cables supported thereby to provide free movement of the cables thereover as the power winches 18 and 20 individually wind and unwind the cables spooled thereon.

As illustrated in FIG. 3, the apparatus 10 may be placed in condition for convenient movement over the ground by securing the support frame assembly 12 to the demountable trailer frame assembly 22. The trailer frame assembly 22 includes a rigid frame structure 172 which is supported for rolling movement over the ground by first and second transverse axles 174 and 176 with each axle carrying a pair of wheels 178 journaled on the opposite ends thereof. The axles 174 and 176 are preferably each secured to the rigid frame structure 172 by means of a pair of leaf springs 180. The longitudinal frame members 26 and 28 of the support frame assembly 12 are supported directly by and on the rigid frame structure 172. The support frame assembly 12 is demountably secured to the rigid frame structure 172 by means of threaded U-bolt clamps 182 which releasably mutually engage the parallel transverse frame members 30 and 32 of the support frame assembly 12 with the respective parallel transverse frame members 184 and 186 of the rigid frame structure 172. Vertically extending guide tabs or plates 188 formed on the transverse frame members 184 and 186 provide for proper positioning of the support frame assembly 12 on the trailer frame assembly 22 prior to the securing of the U-bolt clamps 182 as mentioned above.

The bifurcated mast assembly 14 is prepared for transport by removing the threaded bolts 144 which secure the butt plates 98 and 124 and 100 and 126 together when the mast assembly 14 is in its erected position. The upper mast frame 70 is then jack-knifed relative to the lower mast frame 64 about the hinged connections between the butt plates. The upper main mast members 118 and 120 are secured to the brace members 94 and 96 of the lower mast frame 64, respectively, by U-bolt clamps 189 to maintain the bifurcated mast assembly 14 in the jack-knifed position during transport.

When the bifurcated mast assembly 14 is in its jack-knifed transport position, the tow bar assembly 24 may then be secured to the lower mast frame 64 of the mast assembly 14. The tow bar assembly 24 includes a suitable hitch connector 190, preferably an open eye. The hitch connector 190 is secured to one end of each of three rigid members 192, 124 and 196 the opposite ends of rigid members 192 and 194 are secured to butt plates 198 and 200, respectively. The opposite end of rigid member 196 is secured to the medial portion 202 of a transverse rigid member 204 interconnecting the lower end portions of the butt plates 198 and 200. The butt plates 198 and 200 are secured to the butt plates 98 and 100 of the lower mast frame 64, respectively by means of the previously removed threaded bolts 144 which extend through aligned apertures formed within the butt plates.

With the support frame assembly 12 demountably secured to the trailer frame assembly 22, and with the mast assembly 14 in its jack-knifed position, with the tow bar assembly 24 secured to the lower mast frame 64 thereof, and with the mast assembly 14 secured in its lowermost position supported to the support frame assembly 12 by means of the previously mentioned bolts 117 securing the plates 110 and 112 of the mast assembly through the flanges 58 and 60 of the support frame assembly, respectively, as mentioned above, the apparatus 10 is in condition for convenient transportation over the ground by towing behind a truck 206 or other suitable vehicle.

The truck 206 to be employed with the apparatus 10 is preferably of conventional design and is equipped with a convenient lifting mechanism on the bed thereof, such as a gin pole, which may be readily employed to erect or extend the mast assembly 14 from its jack-knifed position and lift the apparatus 10 from the trailer frame assembly 22 and properly position it on the walk 208 of a conventional drilling rig pipe rack 210.

As shown in FIG. 1, the support frame assembly 12 of the apparatus 10 may be conveniently secured to the walk 208 of a pipe rack 210 by means of threaded bolts 212 extending downwardly through apertures formed in the transverse frame members 30 and 32 supported on top of the walk 208 and received in aligned apertures in transverse clamping members 214 and 216 extending beneath the walk 208 and parallel to the transverse frame members 30 and 32.

Figure 8:
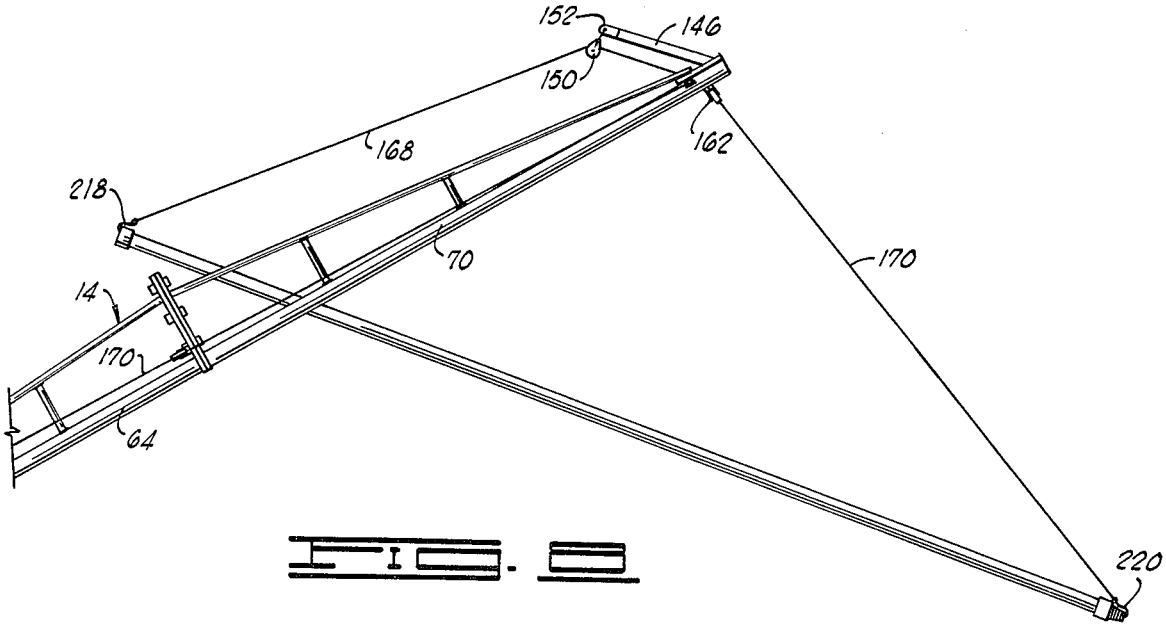
FIG. 8 is a partial side elevation view of the apparatus of the present invention illustrating alternative structure for handling relatively large diameter lengths of tubing such as oil well casing.
Figure 10:
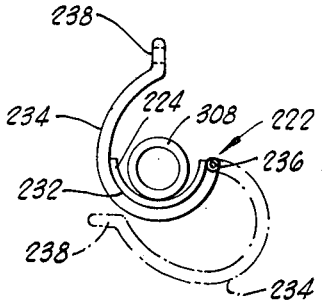
FIG. 10 is an enlarged view taken along line 10—10 of FIG. 1.
Figure 11:
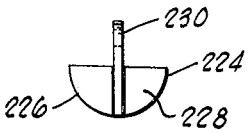
FIG. 11 is an enlarged view taken along line 11—11 of FIG. 1.

If the apparatus 10 is to be employed in moving large diameter lengths of casing, it may be preferable to secure hooks 218 and 220 to the ends of cables 168 and 170 to engage the opposite ends of the lengths of casing as shown in FIG. 8. When the apparatus 10 is to be employed in the movement of lengths of drill pipe, or small diameter lengths of casing, it may be desirable to secure the cables 168 and 170 to a trough assembly 222 as illustrated in FIGS. 1, 10 and 11. The trough assembly 222 includes an elongated trough 224 open at the top along the full length thereof. The trough 224 may be suitably constructed of one-half of a longitudinally split length of large diameter casing of approximately 25 feet in length. One end 226 of the trough 224 is closed by an end plate 228 having a lifting eye 230 secured thereto. The cable 170 is secured to the lifting eye 230. The opposite end 232 of the trough 224 is open and includes an arcuately shaped connecting member 234 having the first end thereof 236 pivotally secured to the exterior of the trough 224 adjacent to the opposite end 232 thereof. The connecting member 234 extends from the first end 236 under and partially encircling the trough 224 to the second end 238 thereof which is secured to the free end of the cable 168. The pivotal movement of the connecting member 234 relative to the trough 224 is illustrated by the dashed lines in FIG. 10.

Figure 9:
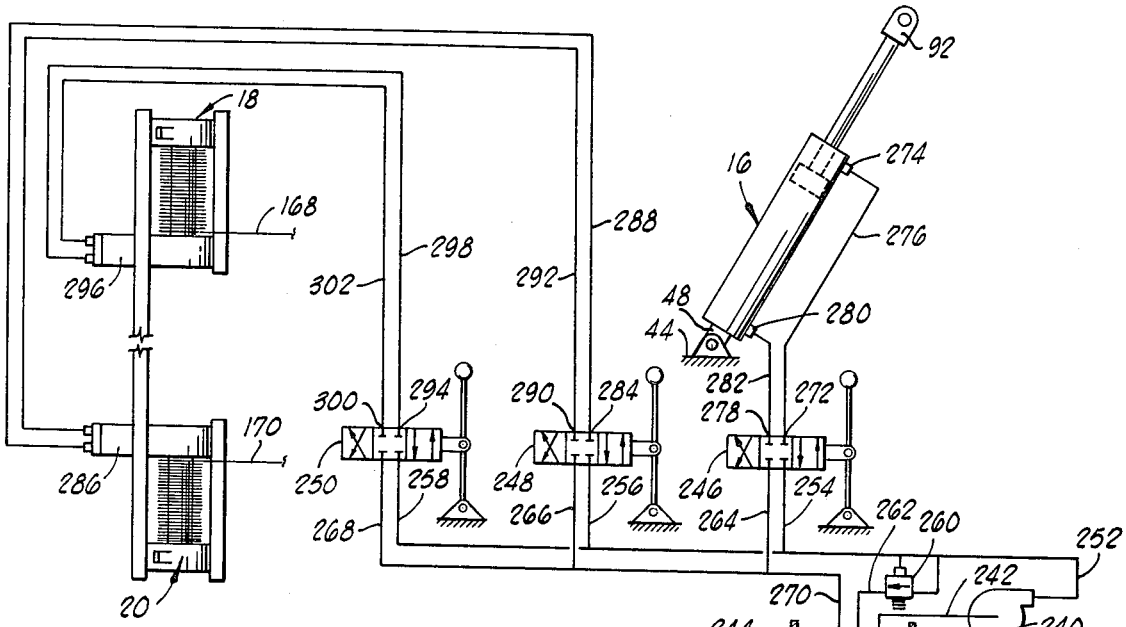
FIG. 9 is a diagrammatical illustration of the hydraulic control system of the present invention.

The hydraulic control system for use with the apparatus 10 is illustrated in FIG. 9. The hydraulic control system includes a hydraulic pump 240 which is preferably mounted on the previously mentioned truck 206 and includes its own drive motor also mounted on the truck. The hydraulic pump 240 is connected by conduit 242 to a hydraulic fluid reservoir 244 also preferably mounted on the truck 206. The output of the hydraulic pump 240 is connected with the input ports of two-way control valve 246, 248 and 250 by means of conduits 252, 254, 256 and 258. The pressure relief valve 260 is interposed on conduit 262 between conduit 252 and the hydraulic fluid reservoir 244. The return ports of the control valves 246, 248 and 250 communicate with the hydraulic fluid reservoir 244 via conduits 264, 266, 268 and 270. Port 272 of control valve 246 is connected to the rod end 274 of the hydraulic power cylinder 16 via conduit 276, and the port 278 of the valve 246 communicates with the piston end 280 of the power cylinder 16 via conduit 282. Port 284 of control valve 248 is connected to one port of the reversible hydraulic motor 286 of the power winch 20 via conduit 288, and port 290 of valve 248 communicates with the other port of the motor 286 via conduit 292. Port 294 of the control valve 250 communicates with one port of the reversible hydraulic motor 296 of power winch 18 via conduit 298, and port 300 of the valve 250 communicates with the other port of the hydraulic motor 296 via conduit 302. It will be understood that the control valves may be suitably mounted on the previously mentioned truck 206 or, if desired, may be mounted directly on the support frame assembly 12 of the apparatus 10. In either case, it will be understood that the interconnecting conduits between the truck 206 and the support frame assembly 12 or mast assembly 14 of the apparatus 10 may include suitable couplings for separating the conduits to facilitate transporting the apparatus 10 and installing the apparatus 10 on the walk 208 of the drilling rig pipe rack 210.

OPERATION OF THE PREFERRED EMBODIMENT

Figure 5:
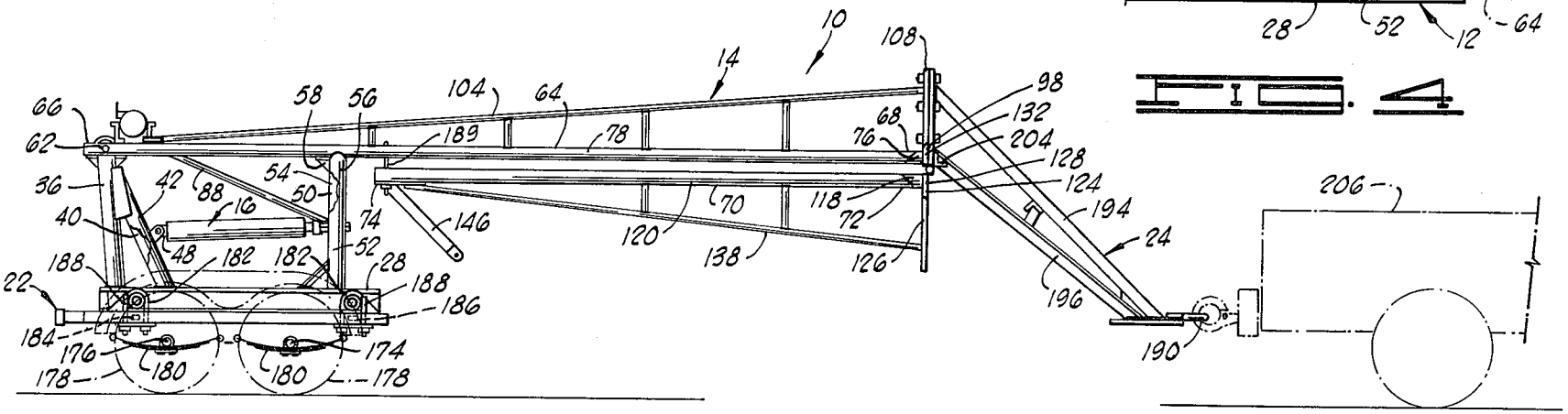
FIG. 5 is a side elevation view of the apparatus of the present invention illustrating the initial phase of the transfer of a length of drill pipe from the pipe rack to the rig floor of a drilling rig.
Figure 5:
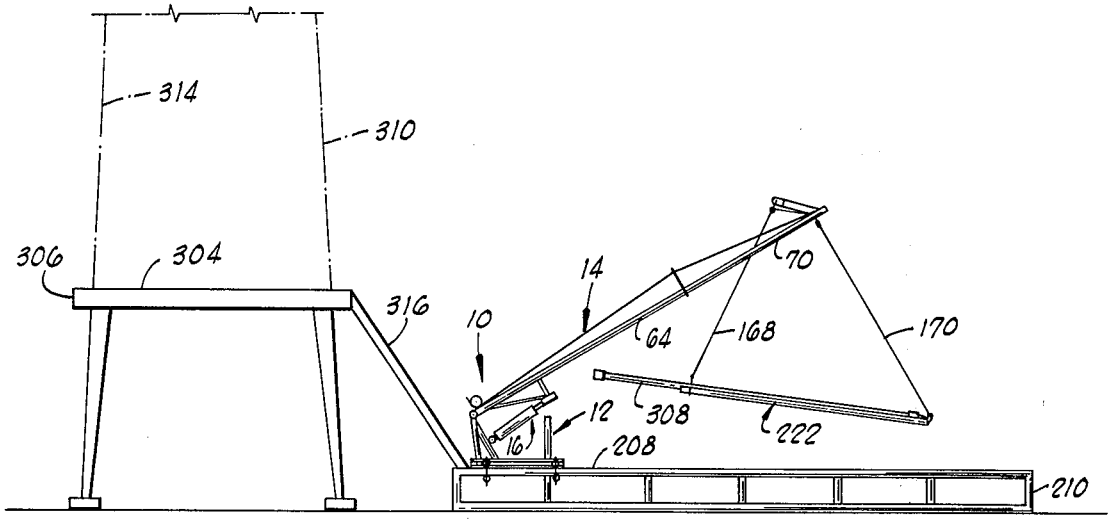
Figure 6:
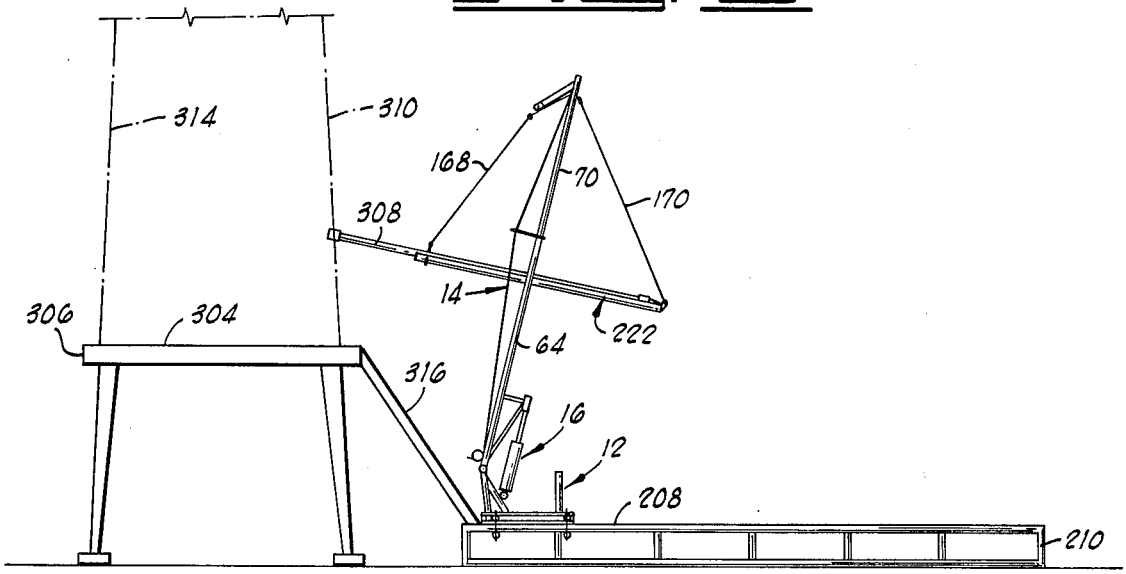
FIG. 6 is a side elevation view of the apparatus of the present invention illustrating the intermediate phase of the transfer of the length of the drill pipe from the pipe rack to the rig floor.
Figure 7:
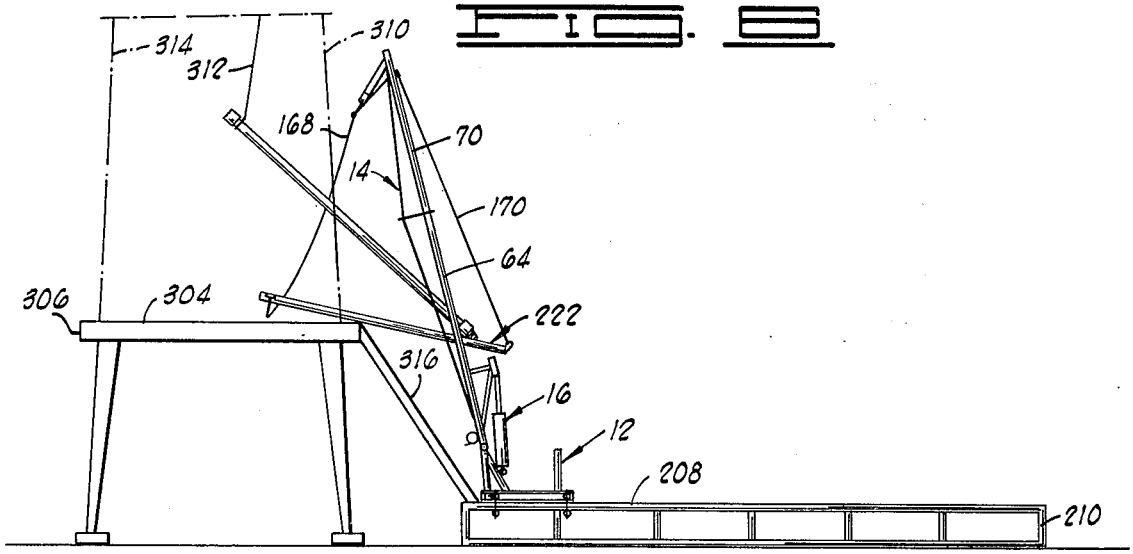
FIG. 7 is a side elevation view of the apparatus of the present invention illustrating the final phase of the transfer of the length of drill pipe from the pipe rack to the rig floor.

Operation of the apparatus 10 is clearly illustrated in FIGS. 5, 6 and 7. In operation, the support frame assembly 12 of the apparatus 10 is secured to the walk 208 of the drilling rig pipe rack 210 as described above. The tow bar assembly 24 is removed from the lower mast frame 64 and the lower mast frame 64 and the upper mast frame 70 are secured together by the threaded bolts 144 to provide a fully erected bifurcated mast assembly 14. The hydraulic fluid conduits interconnecting the truck 206 with the apparatus 10 are connected as illustrated in FIG. 9. The cables 168 and 170 are secured to the trough assembly 222 as previously described. The hydraulic pump 240 is then started to provide pressurized hydraulic fluid for the operation of the hydraulic control system.

Assuming now that drill pipe is desired to be moved from the drilling rig pipe rack 210 to the floor 304 of a drilling rig 306, a length of drill pipe 308 is positioned within the trough assembly 222 which has previously been positioned on the walk 208, as shown in FIG. 1, by unwinding the cables 168 and 170 from the power winches 18 and 20 through suitable manipulation of the control valves 250 and 248 in a manner as will be clearly seen. With the trough assembly 222 in this position lying on a walk 208, the length of drill pipe 308 may be conveniently rolled into the trough assembly from the pipe rack 210.

With the length of drill pipe 308 in the trough assembly 222 as illustrated in FIG. 5, cables 168 and 170 are slowly wound onto the winches 18 and 20 until the proper length of depending cable is achieved below the partially elevated mast assembly 14. The mast assembly 14 is elevated to this initial position by applying pressurized hydraulic fluid to the piston end 280 of the power cylinder 16 through proper manipulation of the control valve 246.

The trough assembly 222 with the length of pipe 308 positioned therein is then lifted from the walk 208 through the extension of the power cylinder 16. FIG. 6 illustrates an intermediate position of the apparatus 10 during the movement of the length of drill pipe 308.

Continued extension of the power cylinder 16 through proper control of the control valve 246 swings the mast assembly 14 up through a substantially vertical position a small distance until the upper end of the length of drill pipe as shown in FIG. 7 and even, in some instances, a portion of the mast assembly 14 enters through the V-door 310 of the drilling rig 306. A suitable lifting cable 312 operated and controlled from the drilling rig 306 is secured to the upper end of the length of drill pipe 308.

The power winches 18 and 20 are then actuated to unwind a sufficient distance to set the trough assembly 222 in contact with the floor 304 of the drilling rig 306. After the trough assembly 222 contacts the floor 304, the operation of the power winch 20 is stopped and the power winch 18 is allowed to unwind a predetermined additional amount permitting slack to form in the cable 168 which permits the connecting member 234 on the trough assembly 222 to swing downwardly beneath the trough 224 thus permitting the length of drill pipe 308 to be lifted upwardly from the trough assembly 222.

The length of drill pipe 308 is then lifted by the lifting cable 312 upwardly into the derrick structure 314 of the drilling rig 306 and the lower end of the drill pipe 308 is allowed to slide along the trough 224 thus protecting the lower end of the drill pipe from any impact with the edge of the rig floor or with the V-door ramp 316 interconnecting the walk 208 and the rig floor 304.

Movement of the lengths of drill pipe from the drilling rig 306 to the pipe rack 210 is achieved by reversing the previously described steps as will be clearly understood by those skilled in the art.

In the event it is desired to move large diameter well casing from the pipe rack 210, it will be desirable to substitute the previously described hooks 218 and 220 for the trough assembly 222. The hooks 218 and 220 will then be engaged in the opposite open ends of a length of casing as shown in FIG. 8 and substantially the same procedure described for moving drill pipe will be undertaken until the length of casing has been positioned within the V-door 310 of the drilling rig 306. The lifting cable 312 is then secured to the upper end of the length of casing by suitable means, not shown, and the upper end of the length of casing is lifted a sufficient distance to release the hook 218 from the open end adjacent to the lifting cable 312. The lower end of the length of casing may be continuously supported by the hook 220 and cable 170 until the upper end of the length of casing is lifted a sufficient distance up into the derrick structure 314 to clear the lower end of the length of casing above the floor 304 of the rig. At this point, the hook 220 is allowed to fall away from the casing and the mast assembly 14 is swung back down to a position extending over the walk 208 through retraction of the power cylinder 16 by suitable manipulation of the control valve 246. It will be understood that removal of lengths of casing from the rig 306 to the pipe rack 210, if such movement is required, will be accomplished by reversing the previously described procedure.

After the movement of the drill pipe or casing, the apparatus 10 may be conveniently removed from the walk 208 and reinstalled on the trailer frame assembly 22 for movement away from the site. The movement preparations also include the folding of the mast assembly 41, the installation of the tow bar assembly 24 on the lower mast frame 64 and the disconnecting of the interconnecting hydraulic conduits between the apparatus 10 and the truck 206.

THE EMBODIMENT OF FIG. 14

In certain circumstances it may be desirable to operate the apparatus 10 with only one power winch. In such cases, the second cable 170 will be secured at its free end to the outer end 152 of the cable supporting arm 146. A suitable cable block 316 will be positioned in the loop end in the cable 170 intermediate the cable supporting arm 146 and the cable pulley or sheave 162. Cables 318 and 320 are each connected at one end thereof to a lifting eye 322 carried by the cable block 316. The opposite end of cable 318 may be secured to either the second end 238 of the connecting member 234 of the trough assembly 222 or the previously described hook 218. In a similar manner, the opposite end of the cable 320 may be secured to the lifting eye 230 of the trough assembly 222 or the previously described hook 220.

Figure 14:
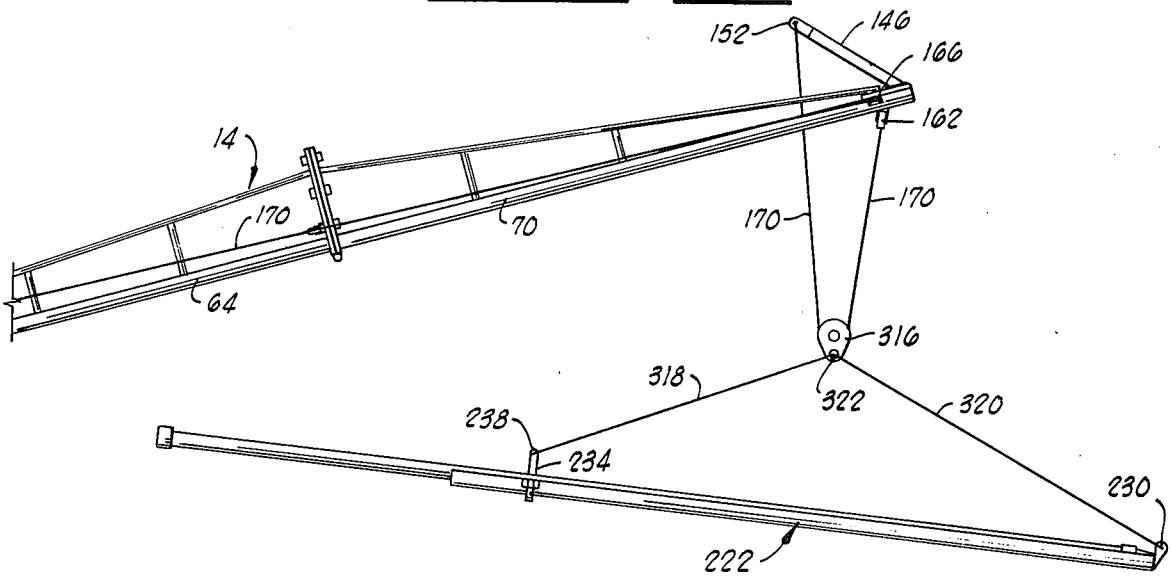
FIG. 14 is a partial side elevation view, similar to FIG. 8, illustrating the alternate form of the present invention.

It will be understood that the operation of the alternate embodiment illustrated in FIG. 14 will be substantially identical to that previously described above for the preferred embodiment. Therefore, this operation will not be described in detail again.

From the foregoing, it will be seen that the apparatus for moving drill pipe and casing into and out of an oil well derrick, the structure and operation of which has been described in detail provides relatively simple, effective, highly portable and relatively inexpensive means for handling lengths of drill pipe and casing while minimizing the possibility of damage to the tubular members and injury to personnel working on and aroung the floor of the derrick and the pipe rack.

Changes may be made in the combination and arrangement of the parts or elements as heretofore set forth in the specification and shown in the drawings without departing from the spirit and scope of the invention as defined by the following claims.

What is claimed is:

1. A pipe-handling apparatus for moving drill pipe and casing back and forth between a position reclining on a horizontal drilling rig pipe rack and a position on the rig floor of the drilling rig, comprising:

a support frame;

a bifurcated mast having first and second ends and pivotally secured at the first end thereof to the support frame;

clamping means carried by the support frame for securing the support frame to the drilling rig pipe rack whereby the mast may rotate relative to the support frame about a horizontal axis;

power cylinder means interconnecting the support frame and the bifurcated mast for rotating the mast about the axis of pivotal securement to the support frame;

a first power winch carried by the support frame adjacent the first end of the bifurcated mast;

sheave means mounted on the second end of the bifurcated mast for rollingly supporting a cable passing thereover;

a cable secured at one end thereof to the first power winch and extending over the sheave means with the opposite end of the cable depending from the second end of the bifurcated mast;

pipe securing means carried on the opposite end of the cable for releasably securing a length of pipe to the cable; and control system means for controlling the extension and retraction of the power cylinder to swing the second end of the bifurcated mast from a position extending over the rig pipe rack to a position adjacent to the floor of the drilling rig and, alternately, from a position adjacent to the floor of the drilling rig to a position extending over the drilling rig pipe rack, and for controlling the operation of the first power winch to alternately wind and unwind the cable thereon.

2. A pipe handling apparatus for moving drill pipe and casing back and forth between a position reclining on a horizontal drilling rig pipe rack and a position on the drilling rig floor, comprising:

a support frame;

a bifurcated mast having first and second ends and pivotally secured at the first end to the support frame;

clamping means carried by the support frame for demountably securing the support frame to the drilling rig pipe rack whereby the axis of rotation of the bifurcated mast relative to the support frame is substantially horizontal;

power cylinder means interconnecting the support frame and the bifurcated mast for rotating the mast about the axis of pivotal securement to the support frame;

a first power winch carried by the support frame adjacent the first end of the bifurcated mast;

a second power winch carried by the support frame adjacent the first end of the bifurcated mast;

first sheave means mounted on the second end of the mast for rollingly supporting a cable passing thereover;

second sheave means mounted on the second end of the mast for rollingly supporting a cable passing thereover;

a first cable secured at one end thereof to the first power winch and extending over the first sheave means with the opposite end thereof depending from the second end of the bifurcated mast;

a second cable connected at one end thereof to the second power winch and extending over the second sheave means with the opposite end thereof depending from the second end of the bifurcated mast;

pipe securing means carried on the opposite ends of the first and second cables for releasably securing a length of pipe to the first and second cables; and control system means for controlling extension and retraction of the power cylinder to swing the second end of the bifurcated mast from a position extending over the drilling rig pipe rack to a position adjacent to the floor of the drilling rig and, alternately, from a position adjacent to the floor of the drilling rig to a position extending over the drilling rig pipe rack, and for controlling the independent operation of the first and second power winches to alternately wind and unwind the first and second cables, respectively, thereon.

3. A portable tubing handling apparatus for moving a length of tubing back and forth between a position reclining on a horizontal drilling ring pipe rack and a position on the drilling rig floor, comprising:

a support frame;

a bifurcated mast having first and second ends and pivotally secured at the first end to the support frame;

trailer frame assembly means comprising a rigid frame and a plurality of wheels journaled thereon for supporting the support frame for movement of the apparatus over the ground;

trailer clamping means for securing the support frame to the trailer frame means for movement of the apparatus over the ground and, alternately, releasing the support frame assembly for installation on the drilling rig pipe rack;

clamping means carried by the support frame for securing the support frame to the drilling rig pipe rack;

power cylinder means interconnecting the support frame and the bifurcated mast for rotating the mast about the axis of pivotal securement to the support frame;

a power winch carried by the support frame adjacent the first end of the bifurcated mast;

sheave means journaled on the second end of the bifurcated mast for rollingly supporting the cable passing thereover;

a winch cable secured at one end thereof to the power winch and extending over the sheave means with the opposite end portion thereof depending from the second end of the bifurcated mast;

tubing securing means carried on the opposite end portion of the winch cable for releasably securing the length of tubing to the cable; and control system means for controlling extension and retraction of the power cylinder to swing the second end of the bifurcated mast from a substantially horizontal position to a substantially vertical position, and alternately, from a substantially vertical position to a substantially horizontal position, and for controlling the operation of the power winch to alternately wind and unwind the winch cable thereon.

4. The apparatus as defined in claim 3 wherein the tubing securing means is characterized further to include:

a cable block rollingly engaged with the opposite end portion of the winch cable;

a first tubing securing cable secured at one end thereof to the cable block and having means formed on the opposite end thereof for releasably securing the first tubing securing cable to one end of a length of tubing; and a second tubing securing cable secured at one end thereof to the cable block and having means formed on the opposite end thereof for releasably securing the second tubing securing cable to the opposite end of the length of tubing.

5. The apparatus as defined in claim 4 wherein the means formed on the opposite ends of the first and second tubing securing cables are hooks.

6. The apparatus as defined in claim 3 wherein the tubing securing means is characterized further to include:

a cable block rollingly engaged with the opposite end portion of the winch cable;

a first tubing securing cable secured at one end thereof to the cable block and having an opposite end;

a second tubing securing cable secured at one end thereof to the cable block and having an opposite end;

an elongated trough open at the top along the full length thereof and having one end open and the opposite end closed, the opposite end thereof being secured to the opposite end of the second tubing securing cable; and a substantially arcuately shaped connecting member having first and second ends and pivotally secured at the first end thereof to the exterior of the elongated trough adjacent the open one end thereof along an axis substantially parallel to the longitudinal axis of the elongated trough, the connecting member extending from the point of pivotal securement under and partially encircling the trough to the second end thereof secured to the opposite end of the first tubing securing cable.

7. A portable tubing handling apparatus for moving a length of tubing back and forth between a position reclining on a substantially horizontal drilling rig pipe rack and a position on the drilling rig floor, comprising:

a support frame;

a bifurcated mast having first and second ends and pivotally secured at the first end to the support frame;

trailer frame assembly means comprising a rigid frame and a plurality of wheels journaled thereon for supporting the support frame for movement of the apparatus over the ground;

trailer clamping means for securing the support frame to the trailer frame assembly means for movement of the apparatus over the ground and, alternately, releasing the support frame from the trailer frame assembly for installation on the drilling rig pipe rack;

clamping means carried by the support frame for securing the support frame to the drilling rig pipe rack;

power cylinder means interconnecting the support frame and the bifurcated mast for rotating the mast about the axis of pivotal securement to the support frame;

a first power winch carried by the support frame adjacent the first end of the bifurcated mast;

first sheave means journaled on the second end of the bifurcated mast for rollingly supporting a cable passing thereover;

a first winch cable secured at one end thereof to the first power winch and extending over the first sheave means with the opposite end portion thereof depending from the second end of the bifurcated mast;

a second power winch carried by the support frame adjacent the first end of the bifurcated mast;

second sheave means journaled on the second end of the bifurcated mast for rollingly supporting a cable passing thereover;

a second winch cable secured at one end thereof to the second power winch and extending over the second sheave means with the opposite end portion thereof depending from the second end of the bifurcated mast;

tubing securing means carried on the opposite end portions of the first and second winch cables for releasably securing a length of tubing to the first and second winch cables; and control system means for controlling extension and retraction of the power cylinder to swing the second end of the bifurcated mast from a substantially horizontal position to a substantially vertical position adjacent the drilling rig floor and, alternately, from a position adjacent the drilling rig floor to a substantially horizontal position, and for controlling the independent operation of the first and second power winches to alternately wind and unwind the first and second winch cables, respectively, thereon.

8. The apparatus as defined in claim 7 wherein the pipe securing means is characterized further to include:

first hook means formed on the opposite end of the first winch cable for releasably engaging one end of a length of tubing; and second hook means formed on the opposite end of the second winch cable for releasably engaging the opposite end of a length of tubing.

9. The apparatus as defined in claim 7 wherein the pipe securing means is characterized further to include:

an elongated trough open at the top along the full length thereof and having one end open and the opposite end closed, the opposite end thereof being secured to the opposite end of the first winch cable; and a substantially arcuately shaped connecting member having first and second ends and pivotally secured at the first end thereof to the exterior of the elongated trough adjacent the open one end thereof along an axis substantially parallel to the longitudinal axis of the elongated trough, the connecting member extending from the point of pivotal securement under and partially encircling the trough to the second end thereof, the second end thereof being secured to the opposite end of the second winch cable.

10. The apparatus as defined in claim 7 characterized further to include:

hinge means interposed in the bifurcated mast intermediate the first and second ends thereof for permitting the folding of the bifurcated mast for movement of the apparatus over the ground.

11. The apparatus as defined in claim 7 characterized further to include:

tow bar means securable to the bifurcated mast for securing the apparatus to a tow vehicle for movement of the apparatus over the ground.

12. The apparatus as defined in claim 7 characterized further to include:

hinge means interposed in the bifurcated mast intermediate the first and second ends thereof for permitting the folding of the bifurcated mast for movement of the apparatus over the ground; and tow bar means securable to the folded bifurcated mast for securing the apparatus to a tow vehicle for movement of the apparatus over the ground.

* * * * *

PO-1050
(5/69)

UNITED STATES PATENT OFFICE
CERTIFICATE OF CORRECTION

Patent No. 3,991,887 Dated November 16, 1976

Inventor(s) Norman L. Trout

It is certified that error appears in the above-identified patent and that said Letters Patent are hereby corrected as shown below:

Column 1, line 9, change "improve" to --improved--.

Column 2, line 54, change "two" to --tow--.

Column 5, line 1, insert --mast-- before "members".

Column 10, line 9, change "aroung" to --around--.

Signed and Sealed this

Eleventh Day of January 1977

[SEAL]

*Attest:*

RUTH C. MASON
*Attesting Officer*

C. MARSHALL DANN
*Commissioner of Patents and Trademarks*